US010538968B2

(12) United States Patent
Chen et al.

(10) Patent No.: US 10,538,968 B2
(45) Date of Patent: Jan. 21, 2020

(54) TORSION IMPACT SPEED ACCELERATION DEVICE

(71) Applicant: CNPC Xibu Drilling Engineering Company Limited, Urumqi (CN)

(72) Inventors: Ruoming Chen, Urumqi (CN); Zongjie Mu, Urumqi (CN); Xin Wang, Urumqi (CN); Xiaojun Li, Urumqi (CN); Ming Yi, Urumqi (CN)

(73) Assignee: CNPC Xibu Drilling Engineering Company Limited, Urumqi (CN)

( * ) Notice: Subject to any disclaimer, the term of this patent is extended or adjusted under 35 U.S.C. 154(b) by 149 days.

(21) Appl. No.: 15/899,727

(22) Filed: Feb. 20, 2018

(65) Prior Publication Data

US 2018/0171717 A1 Jun. 21, 2018

Related U.S. Application Data

(63) Continuation of application No. PCT/CN2016/082977, filed on May 23, 2016.

(30) Foreign Application Priority Data

Oct. 1, 2015 (CN) ..... 2015 1 0636735

(51) Int. Cl.
*E21B 4/14* (2006.01)
*E21B 4/16* (2006.01)

(52) U.S. Cl.
CPC . *E21B 4/14* (2013.01); *E21B 4/16* (2013.01)

(58) Field of Classification Search
CPC ..... E21B 4/14; E21B 4/16
See application file for complete search history.

(56) References Cited

U.S. PATENT DOCUMENTS 4,312,412 A * 1/1982 Pillow ..... E21B 4/14 173/136
4,333,537 A * 6/1982 Harris ..... E21B 4/14 173/17

(Continued)

FOREIGN PATENT DOCUMENTS

CN 1053101 A 7/1991
CN 102454364 A 5/2012

(Continued)

OTHER PUBLICATIONS

International Search Report for co-pending International Application No. PCT/CN2016/082977 dated Jul. 12, 2016 with English translation.

(Continued)

*Primary Examiner* — D. Andrews

(74) *Attorney, Agent, or Firm* — Renner, Otto, Boisselle & Sklar, LLP

(57) ABSTRACT

The present disclosure relates to the technical field of well drilling speed acceleration devices, and particularly to a torsion impact speed acceleration device, comprising: a main body (1), an anvil (2), an impact hammer (3), a conversion member (4), a mandrel (5) and a throttle nozzle (6); an inner limiting boss (7) is provided at an upper inner side of the main body (1), a drainage member (9) is mounted between the inner limiting boss (7) and the anvil (2), and a lower conical annular platform (24) which is a frustum having a wide upper portion and a narrow lower portion is provided at an upper inner side of the throttle nozzle (6). The present disclosure has a reasonable and compact structure and is convenient to be used. During a usage, the present disclosure provides an additional impact force to a PDC drill bit through an impact action on the anvil (2) made by the impact hammer (3), thereby reducing the drill capacity aggregation of the PDC drill bit, preventing the gear tooth breakage of the PDC drill bit occurred during drilling, also preventing the entire drill string from fatigue damage and extending the service life of the PDC drill bit on the condition that the drill speed of the PDC drill bit can be increased.

24 Claims, 5 Drawing Sheets

(56) References Cited

U.S. PATENT DOCUMENTS

| | | | |
|---|---|---|---|
| 4,662,459 | A | 5/1987 | Bodine |
| 5,305,837 | A | 4/1994 | Johns et al. |
| 2005/0241842 | A1 | 11/2005 | Marsh |

FOREIGN PATENT DOCUMENTS

| | | | |
|---|---|---|---|
| CN | 102536114 | A | 7/2012 |
| CN | 103075097 | A | 5/2013 |
| CN | 103244052 | A | 8/2013 |
| CN | 203430420 | U | 2/2014 |
| CN | 104533283 | A | 4/2015 |
| CN | 104612582 | A | 5/2015 |
| CN | 105156027 | A | 12/2015 |
| CN | 204984255 | U | 1/2016 |
| EP | 0 851 090 | A1 | 7/1998 |

OTHER PUBLICATIONS

Written Opinion of the International Searching Authority for co-pending International Application No. PCT/CN2016/082977 dated Jul. 12, 2016.

First Office Action and Search Report issued in co-pending Chinese Application No. 201510636735.8 dated Jan. 25, 2017 with English translation.

* cited by examiner

TORSION IMPACT SPEED ACCELERATION DEVICE

TECHNICAL FIELD

The present disclosure relates to the technical field of well drilling speed acceleration devices, and particularly to a torsion impact speed acceleration device.

BACKGROUND

In the process of oilfield exploitation and development, accelerating the penetration rate is a forever theme of petroleum exploration and development. Currently, merely in the aspect of accelerating the penetration rate, a lot of researches have been carried out at home and abroad, and put into site applications to achieve a good speed acceleration effect. With the continuous development of the drilling industry and the professional persons' increasingly deep-going researches on the PDC drill bit in the drilling process, people gradually find that when the PDC drill bit shears (grinds) a stratum, the cutting gear tooth cannot effectively cut the stratum instantaneously, and the torque energy generated by a rotary table on the ground is gradually aggregated on the blade of the PDC drill bit and the whole drill string. When the energy is aggregated to a certain degree, the stratum is sheared instantaneously, and the energy aggregated on the blade of the PDC drill bit and the whole drill string is released at the same time, which leads to the results such as the gear tooth breakage and the blade damage on the PDC drill bit, thereby decreasing the service life of the PDC drill bit, and causing fatigue damage of the whole drill string. In earlier researches on the acceleration tools, the professional persons focused on the development of axial jolting tools to accelerate the speed of the PDC drill bit. Those tools have substantially the same working principle, i.e., to generate an axially downward jolting force through different levels of hydraulic cylinders under the effect of hydraulic pressure, so as to accelerate the penetration rate. In recent years, the self-oscillation speed acceleration tools also occur and achieve some effect at site. Those tools increase the penetration rate at a certain extent, but cannot fundamentally solve the problem of the gear tooth breakage of the PDC drill bit occurred during drilling, and are not widely used. Meanwhile, since those tools have sealing members, their service lives are not too long.

SUMMARY

The present disclosure provides a torsion impact speed acceleration device to overcome the above deficiencies of the prior art, which can effectively solve the problem of the gear tooth breakage of the PDC drill bit occurred during drilling when the existed well drilling speed acceleration device is practically used.

The technical solutions of the present disclosure are implemented as follows.

A torsion impact speed acceleration device, comprising a main body, an anvil, an impact hammer, a conversion member, a mandrel and a throttle nozzle; an inner limiting boss is provided at an upper inner side of the main body, a drainage member is mounted between the inner limiting boss and the anvil, a lower conical annular platform which is a frustum having a wide upper portion and a narrow lower portion is provided at an upper inner side of the throttle nozzle, a lower portion of the anvil is fixed with a lower portion of the main body through locating devices, an upper outer side of the mandrel is fixed with a lower inner side of the drainage member, a lower outer side of the mandrel is fixed with a lower inner side of the anvil, an outer side of the throttle nozzle is fixed with a lower inner side of the mandrel, the conversion member and the impact hammer are sheathed sequentially between an outer side of the mandrel and an inner side of the anvil, an annular liquid flow cavity is provided between a middle outer side of the mandrel and an upper inner side of the conversion member, at least one first radial liquid flow via-hole in communication with the annular liquid flow cavity is distributed circumferentially on the mandrel above the throttle nozzle, an inner side of the impact hammer is provided with a first groove and a second groove, an outer side of the conversion member is provided with a first slider rotatable circumferentially in the first groove and a second slider rotatable circumferentially in the second groove, a second radial liquid flow via-hole and a third radial liquid flow via-hole both in communication with the annular liquid flow cavity are distributed circumferentially on the second slider, the second radial liquid flow via-hole is located on the second slider between the first slider and the third radial liquid flow via-hole, the inner side of the anvil is provided with a third groove, an outer side of the impact hammer corresponding to and outward of the second groove is provided with a third slider rotatable circumferentially in the third groove, a fourth radial liquid flow via-hole capable of being in communication with the second radial liquid flow via-hole and a fifth radial liquid flow via-hole capable of being in communication with the third radial liquid flow via-hole are distributed circumferentially on the impact hammer and adjoin two sides of the third slider, respectively, an annular liquid cavity is provided between the outer side of the mandrel and the inner side of the anvil below the conversion member and the impact hammer, and an inclined flow channel in communication with the annular liquid cavity is provided on the mandrel below the throttle nozzle.

The above technical solution of the present disclosure is further optimized and/or improved as follows.

An upper conical annular platform which is a frustum having a wide upper portion and a narrow lower portion is provided at an upper inner side of the drainage member, a buffering groove is provided at a middle outer side of the drainage member, a drainage hole in communication with the buffering groove is provided on the drainage member, a left drainage elongated slot and a right drainage elongated slot both in communication with the buffering groove are provided at a lower outer side of the drainage member, and a left-semicircle opened elongated slot and a right-semicircle opened elongated slot are distributed at an outer side of the anvil, wherein the left drainage elongated slot and the left-semicircle opened elongated slot are up-down corresponding to and communicated with each other, and the right drainage elongated slot and the right-semicircle opened elongated slot are up-down corresponding to and communicated with each other.

A sixth radial liquid flow via-hole in communication with the first groove is provided on a portion of the impact hammer corresponding to and outward of the first groove, a seventh radial liquid flow via-hole in communication with the second groove is provided on a portion of the impact hammer corresponding to and outward of the second groove, and an eighth radial liquid flow via-hole capable of being in communication with the sixth radial liquid flow via-hole and a ninth radial liquid flow via-hole capable of being in communication with the seventh radial liquid flow via-hole are distributed circumferentially on the anvil, wherein the ninth radial liquid flow via-hole is in communication with the left-semicircle opened elongated slot, and the eighth radial liquid flow via-hole is in communication with the right-semicircle opened elongated slot.

The locating device comprises a detent ball, a detent board, a compression spring and a pressing cap, wherein at least two locating blind holes are distributed circumferentially at an interval at an outer side of the anvil, locating threaded holes corresponding to the locating blind holes are distributed on the main body, the pressing cap is fixedly mounted in the locating threaded hole, and the compression spring, the detent board and the detent ball are compressively mounted in this order in the locating blind hole and the locating threaded hole.

A first limiting annular boss is provided at the outer side of the mandrel above the inclined flow channel, the conversion member is seated on the first limiting annular boss, a second limiting annular boss is provided at the inner side of the anvil above the annular liquid cavity, the impact hammer is seated on the second limiting annular boss, a limiting bump is provided at a lower outer side of the conversion member, a limiting open groove corresponding to the limiting bump is provided at the inner side of the impact hammer, and the limiting bump abuts against an inner side of the limiting open groove.

An outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

The present disclosure has a reasonable and compact structure and is convenient to be used. During a usage, the present disclosure provides an additional impact force to a PDC drill bit through an impact action on the anvil made by the impact hammer, thereby reducing the drill capacity aggregation of the PDC drill bit, preventing the gear tooth breakage of the PDC drill bit occurred during drilling, also preventing the entire drill string from fatigue damage and extending the service life of the PDC drill bit on the condition that the drill speed of the PDC drill bit can be increased.

BRIEF DESCRIPTIONS OF THE DRAWINGS

In order to more clearly describe the technical solutions in the embodiments of the present disclosure, the drawings to be used in the descriptions of the embodiments will be briefly introduced as follows. Obviously, the drawings in the following descriptions just illustrate some embodiments of the present disclosure, and a person skilled in the art can obtain other drawings from them without paying any creative labor.

Figure 1:
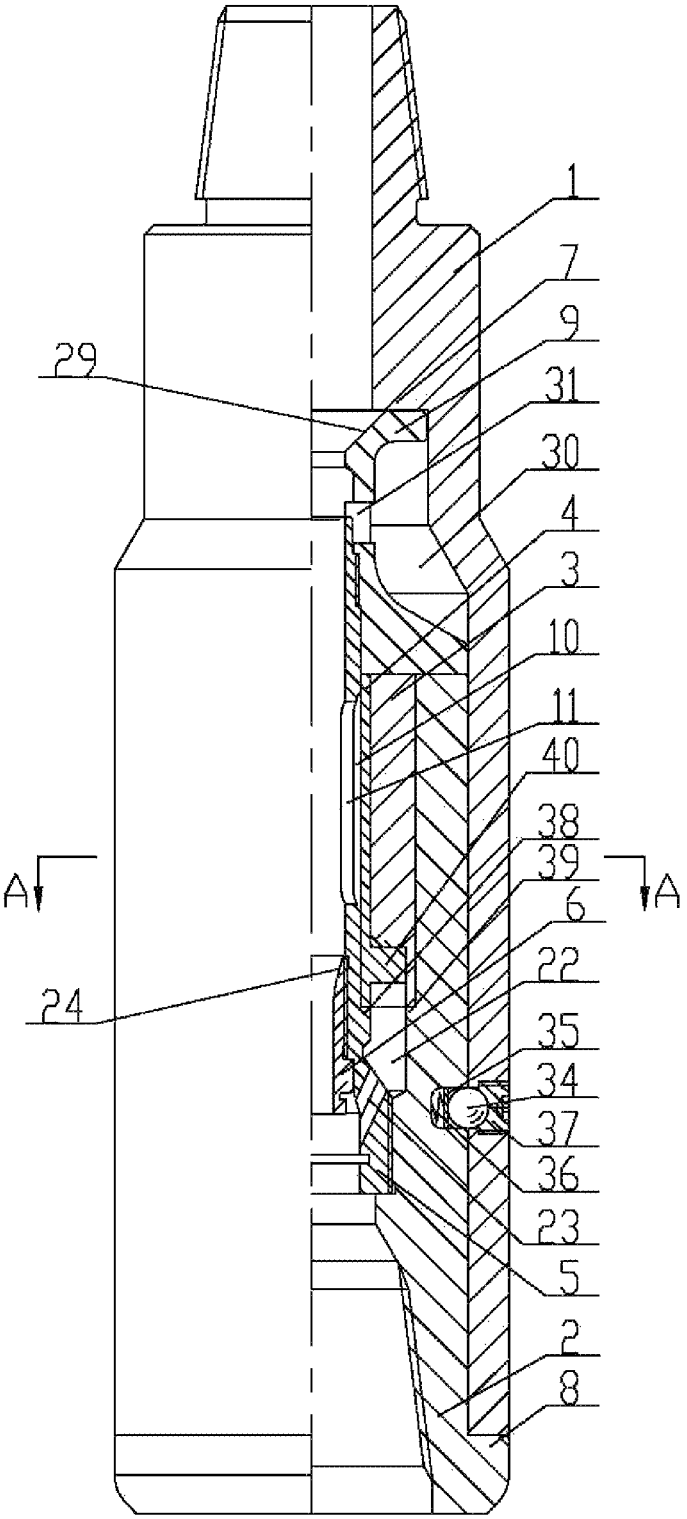
FIG. 1 illustrates a front-viewed half-sectional structure diagram of an optimum embodiment of the present disclosure.

The reference numerals in the drawings are 1: main body; 2: anvil; 3: impact hammer; 4: conversion member; 5: mandrel; 6: throttle nozzle; 7: inner limiting boss; 8: outer limiting boss; 9: drainage member; 10: annular liquid flow cavity; 11: first radial liquid flow via-hole; 12: first groove; 13: second groove; 14: first slider; 15: second slider; 16: second radial liquid flow via-hole; 17: third radial liquid flow via-hole; 18: third groove; 19: third slider; 20: fourth radial liquid flow via-hole; 21: fifth radial liquid flow via-hole; 22: annular liquid cavity; 23: inclined flow channel; 24: lower conical annular platform; 25: sixth radial liquid flow via-hole; 26: seventh radial liquid flow via-hole; 27: eighth radial liquid flow via-hole; 28: ninth radial liquid flow via-hole; 29: upper conical annular platform; 30: buffering groove; 31: drainage hole; 32: left-semicircle opened elongated slot; 33: right-semicircle opened elongated slot; 34: detent ball; 35: detent board; 36: compression spring; 37: pressing cap; 38: first limiting annular boss; 39: second limiting annular boss; 40: limiting bump; 41: circumferential bump; and 42: liquid flow elongated slot.

DETAILED DESCRIPTIONS OF THE PREFERRED EMBODIMENTS

Next, the technical solutions in the embodiments of the present disclosure will be clearly and completely described with reference to the drawings in the embodiments of the present disclosure. Obviously, those described are just a part rather than all of the embodiments of the present disclosure. Based on the embodiments of the present disclosure, any other embodiment obtained by a person skilled in the art without paying any creative effort shall fall within the protection scope of the present disclosure.

The present disclosure is not restricted by the following embodiments, and the specific embodiment can be determined based on the technical solutions of the present disclosure and the actual conditions.

In the present disclosure, in order to facilitate the description, the relative position relations between various parts, such as front, rear, upper, lower, left and right, are all described with reference to the layout of FIG. 1.

Next, the present disclosure will be further described as follows in conjunction with the embodiments and the drawings.

As illustrated in FIGS. 1 to 5, the torsion impact speed acceleration device comprises a main body 1, an anvil 2, an impact hammer 3, a conversion member 4, a mandrel 5 and a throttle nozzle 6; an inner limiting boss 7 is provided at an upper inner side of the main body 1, a drainage member 9 is mounted between the inner limiting boss 7 and the anvil 2, a lower conical annular platform 24 which is a frustum having a wide upper portion and a narrow lower portion is provided at an upper inner side of the throttle nozzle 6, a lower portion of the anvil 2 is fixed with a lower portion of the main body 1 through locating devices, an upper outer side of the mandrel 5 is fixed with a lower inner side of the drainage member 9, a lower outer side of the mandrel 5 is fixed with a lower inner side of the anvil 2, an outer side of the throttle nozzle 6 is fixed with a lower inner side of the mandrel 5, the conversion member 4 and the impact hammer 3 are sheathed sequentially between an outer side of the mandrel 5 and an inner side of the anvil 2, an annular liquid flow cavity 10 is provided between a middle outer side of the mandrel 5 and an upper inner side of the conversion member 4, at least one first radial liquid flow via-hole 11 in communication with the annular liquid flow cavity 10 is distributed circumferentially on the mandrel 5 above the throttle nozzle 6, an inner side of the impact hammer 3 is provided with a first groove 12 and a second groove 13, an outer side of the conversion member 4 is provided with a first slider 14 rotatable circumferentially in the first groove 12 and a second slider 15 rotatable circumferentially in the second groove 13, a second radial liquid flow via-hole 16 and a third radial liquid flow via-hole 17 both in communication with the annular liquid flow cavity 10 are distributed circumferentially on the second slider 15, the second radial liquid flow via-hole 16 is located on the second slider 15 between the first slider 14 and the third radial liquid flow via-hole 17, the inner side of the anvil 2 is provided with a third groove 18, an outer side of the impact hammer 3 corresponding to the second groove 13 is provided with a third slider 19 rotatable circumferentially in the third groove 18, a fourth radial liquid flow via-hole 20 capable of being in communication with the second radial liquid flow via-hole 16 and a fifth radial liquid flow via-hole 21 capable of being in communication with the third radial liquid flow via-hole 17 are distributed circumferentially on the impact hammer 3 and adjoin two sides of the third slider 19, respectively, an annular liquid cavity 22 is provided between the outer side of the mandrel 5 and the inner side of the anvil 2 below the conversion member 4 and the impact hammer 3, and an inclined flow channel 23 in communication with the annular liquid cavity 22 is provided on the mandrel 5 below the throttle nozzle 6. During usage, the present disclosure subtly converts the fluid (high pressure fluid) energy into torsional, high-frequency, uniform and stable mechanical impact energy and directly transfers it to the PDC drill bit, so that the PDC drill bit is always consistent with the well bottom, and the PDC drill bit can cut the stratum without waiting for enough energy to be accumulated by a torsional force. In that case, two forces are applied on the PDC drill bit to cut the stratum: one is a torsional force provided by a rotary table on the ground, and the other is a force provided by the present disclosure. The force provided by the present disclosure is directly applied to the PDC drill bit, without producing any influence on the drill stem or changing the load of the entire impact energy. Thus, the torque of the drill stem is substantially stable during drilling, and the torque transferred by the drill stem can be completely used for cutting a stratum without any waste. It is clear that the present disclosure provides an additional impact force to the PDC drill bit through an impact action on the anvil made by the impact hammer, thereby reducing the drill capacity aggregation of the PDC drill bit, preventing the gear tooth breakage of the PDC drill bit occurred during drilling, also preventing the entire drill string from fatigue damage and extending the service life of the PDC drill bit on the condition that the drill speed of the PDC drill bit can be increased. In the process where the impact hammer 3 impacts the anvil 2, some high-pressure fluid enters the first groove 12 and the second groove 13 and orderly flows through the annular liquid cavity 22 and the inclined flow channel 23, thereby effectively preventing the occurrence of pressure building in the present disclosure, and ensuring that the present disclosure can smoothly perform the operations.

It is defined a set of impact structures composed of the first groove 12 and the second groove 13 provided in the impact hammer 3, the first slider 14 rotatable circumferentially in the first groove 12 and the second slider 15 rotatable circumferentially in the second groove 13, the second radial liquid flow via-hole 16 and the third radial liquid flow via-hole 17 provided on the second slider 15, the third groove 18 provided in the anvil 2, the third slider 19 provided at the outer side of the impact hammer 3 and rotatable circumferentially in the third groove 18, and the fourth radial liquid flow via-hole 20 capable of being in communication with the second radial liquid flow via-hole 16 and the fifth radial liquid flow via-hole 21 capable of being in communication with the third radial liquid flow via-hole 17 which are distributed circumferentially on the impact hammer 3. In another embodiment of the present disclosure, based on the actual application requirement, the torsion impact speed acceleration device may be circumferentially provided with a plurality of sets of impact structures.

In addition, in one embodiment of the present disclosure, the mandrel 5 and the conversion member 4 sheathing the mandrel 5 can be integrally formed.

Figure 6:
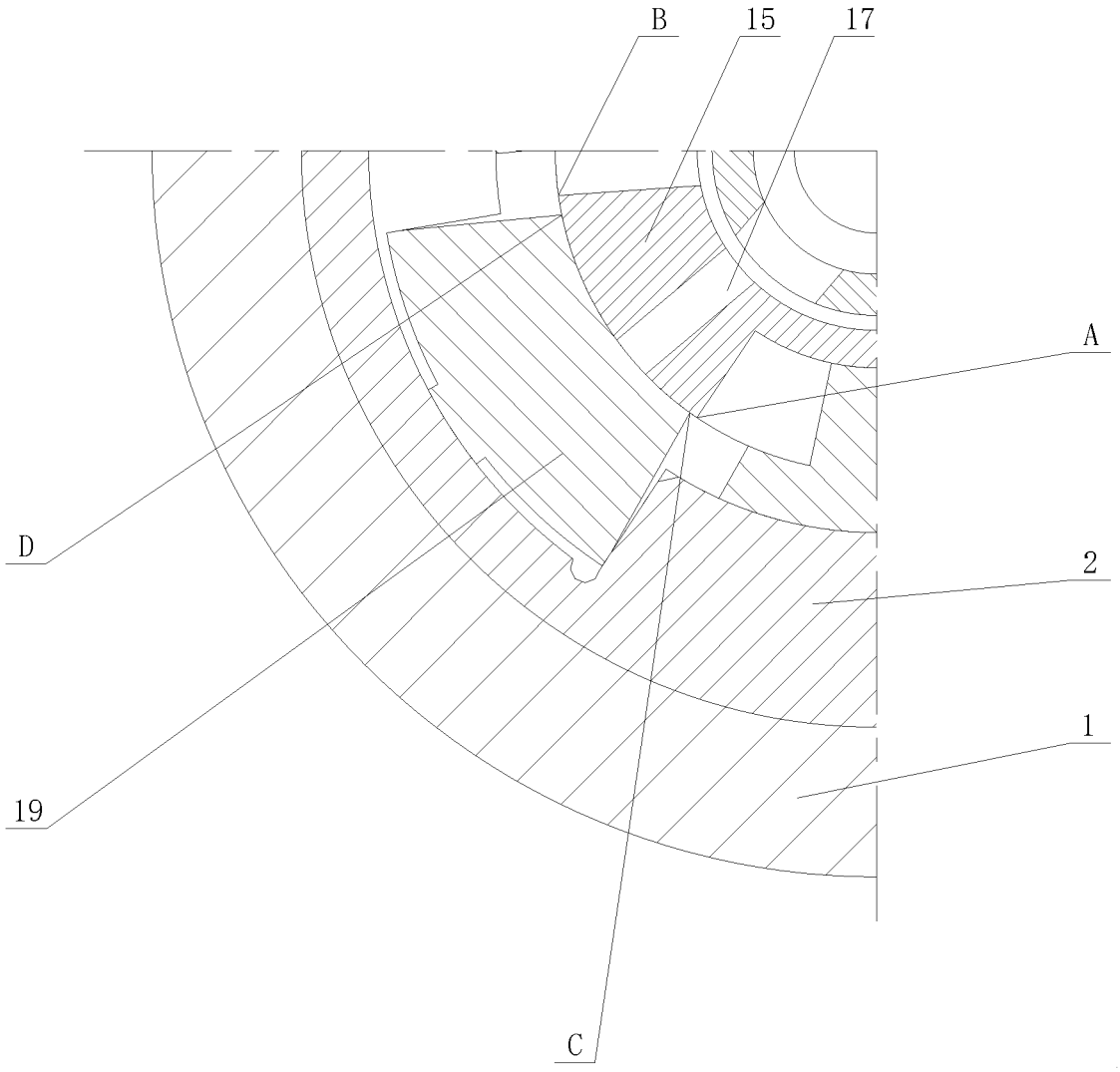
FIG. 6 illustrates a partial enlarged diagram of FIG. 2.

Further, in the present disclosure, a length of an outer arc between a rear side of the third radial liquid flow via-hole 17 and a rear side of the second slider 15 is larger than a length of an inner arc of the third slider 19, i.e., as illustrated in FIG. 6, a length of an outer arc between A and B is larger than a length of an inner arc between C and D.

Based on the actual requirement, the torsion impact speed acceleration device may be further optimized and/or improved.

As illustrated in FIGS. 1 to 5, an upper conical annular platform 29 which is a frustum having a wide upper portion and a narrow lower portion is provided at an upper inner side of the drainage member 9, a buffering groove 30 is provided at a middle outer side of the drainage member 9, a drainage hole 31 in communication with the buffering groove 30 is provided on the drainage member 9, a left drainage elongated slot and a right drainage elongated slot both in communication with buffering groove 30 are provided at a lower outer side of the drainage member 9, and a left-semicircle opened elongated slot 32 and a right-semicircle opened elongated slot 33 are distributed at an outer side of the anvil 2, wherein the left drainage elongated slot and the left-semicircle opened elongated slot 32 are up-down corresponding to and communicated with each other, and the right drainage elongated slot and the right-semicircle opened elongated slot 33 are up-down corresponding to and communicated with each other. When its amount is too large or its pressure is too high, the high-pressure fluid can enter the buffering groove 30 through the drainage hole 31, then pass through the left drainage elongated slot, the right drainage elongated slot, the left-semicircle opened elongated slot 32 and the right-semicircle opened elongated slot 33, and flow to the below of the anvil 2, thereby ensuring the safe operation of the present disclosure.

As illustrated in FIGS. 1 to 5, a sixth radial liquid flow via-hole 25 in communication with the first groove 12 is provided on a portion of the impact hammer 3 corresponding to and outward of the first groove 12, a seventh radial liquid flow via-hole 26 in communication with the second groove 13 is provided on a portion of the impact hammer 3 corresponding to and outward of the second groove 13, and an eighth radial liquid flow via-hole 27 capable of being in communication with the sixth radial liquid flow via-hole 25 and a ninth radial liquid flow via-hole 28 capable of being in communication with the seventh radial liquid flow via-hole 26 are distributed circumferentially on the anvil 2, wherein the ninth radial liquid flow via-hole 28 is in communication with the left-semicircle opened elongated slot 32, and the eighth radial liquid flow via-hole 27 is in communication with the right-semicircle opened elongated slot 33. The high-pressure fluids in the eighth radial liquid flow via-hole 27 and the ninth radial liquid flow via-hole 28 can be discharged through the left-semicircle opened elongated slot 32 and the right-semicircle opened elongated slot 33, respectively.

As illustrated in FIGS. 1 to 5, the locating device comprises a detent ball 34, a detent board 35, a compression spring 36 and a pressing cap 37, wherein at least two locating blind holes are distributed circumferentially at an interval at the outer side of the anvil 2, locating threaded holes corresponding to the locating blind holes are distributed on the main body 1, the pressing cap 37 is fixedly mounted in the locating threaded hole, and the compression spring 36, the detent board 35 and the detent ball 34 are compressively mounted in this order in the locating blind hole and the locating threaded hole. The arrangement of the detent ball 34, the detent board 35, the compression spring 36 and the pressing cap 37 facilitates the dismounting of the main body 1 and the anvil 2.

As illustrated in FIGS. 1 to 5, a first limiting annular boss 38 is provided at the outer side of the mandrel 5 above the inclined flow channel 23, the conversion member 4 is seated on the first limiting annular boss 38, a second limiting annular boss 39 is provided at the inner side of the anvil 2 above the annular liquid cavity 22, the impact hammer 3 is seated on the second limiting annular boss 39, a limiting bump 40 is provided at a lower outer side of the conversion member 4, a limiting open groove corresponding to the limiting bump 40 is provided at the inner side of the impact hammer 3, and the limiting bump 40 abuts against an inner side of the limiting open groove.

As illustrated in FIGS. 1 to 5, an outer limiting boss 8 is provided at a lower outer side of the anvil 2, the main body 1 is seated on the outer limiting boss 8, an internal thread or an external thread is provided at an upper portion of the main body 1, an internal thread is provided at the lower portion of the anvil 2, the upper outer side of the mandrel 5 and the lower inner side of the drainage member 9 are mounted together by thread tightening, the lower outer side of the mandrel 5 and the lower inner side of the anvil 2 are mounted together by thread tightening, the outer side of the throttle nozzle 6 and a lower inner side of the mandrel 5 are mounted together by thread tightening, and/or a circumferential bump 41 is provided at an outer side of the second slider 15 at a rear side of the second radial liquid flow via-hole 16, and a liquid flow elongated slot 42 is provided between the circumferential bump 41 and the rear side of the second radial liquid flow via-hole 16. The high-pressure fluid entering the liquid flow elongated slot 42 can flow into the annular liquid cavity 22 through the liquid flow elongated slot 42.

The above technical features constitute the optimum embodiment of the present disclosure, which has a strong adaptability and a best implementation effect. Unnecessary technical features can be added or deleted upon actual demand to meet the requirements under different conditions.

Figure 2:
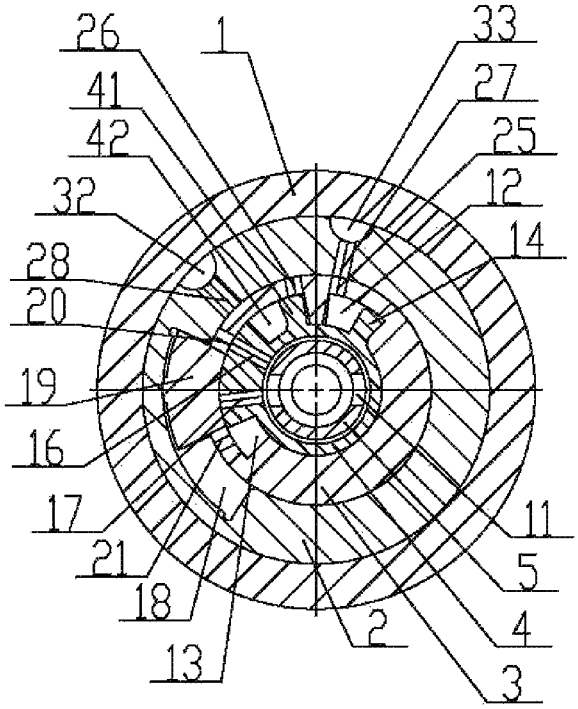
FIG. 2 illustrates a sectional structure diagram in direction A-A of FIG. 1.
Figure 3:
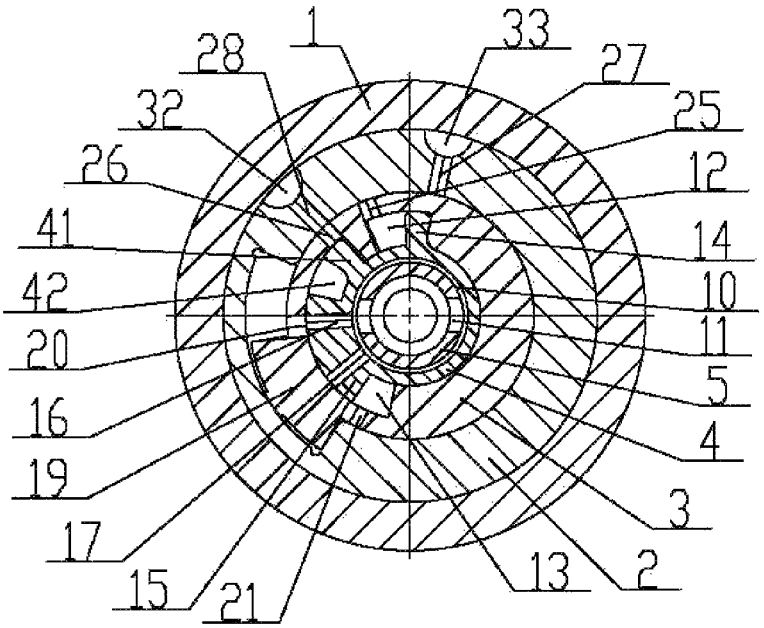
FIG. 3 illustrates a structure diagram in which a third slider in FIG. 2 is anticlockwise rotated to a front side of a third groove.
Figure 4:
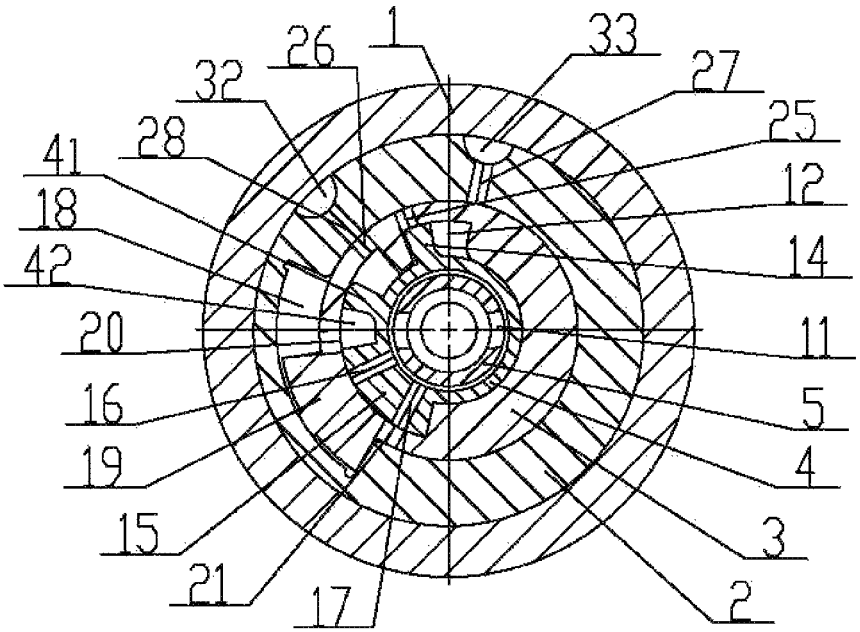
FIG. 4 illustrates a structure diagram in which a second slider in FIG. 3 is anticlockwise rotated to a front side of a second groove.
Figure 5:
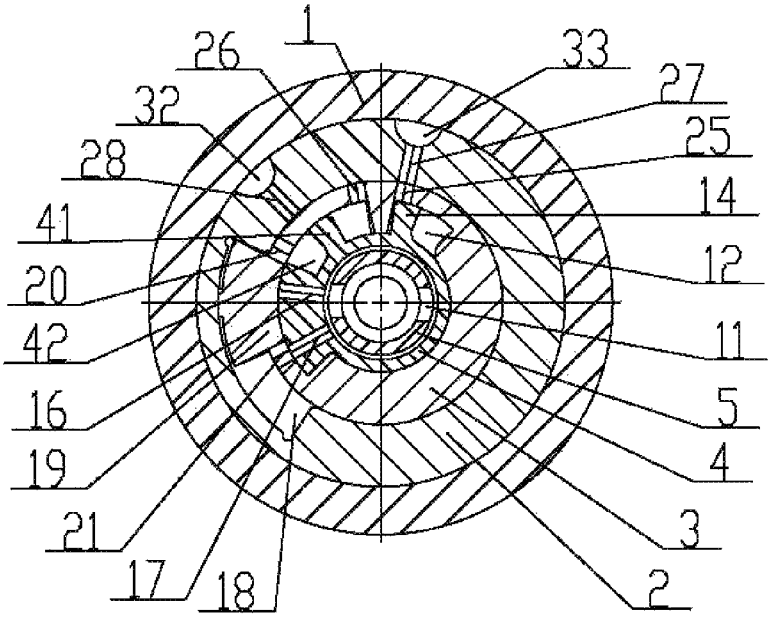
FIG. 5 illustrates a structure diagram in which a third slider in FIG. 4 is clockwise rotated to a rear side of a third groove.

The use process of the optimum embodiment of the present disclosure is as follows. Firstly, the anvil 2 is directly connected to the PDC drill bit, the upper portion of the main body 1 is threadedly connected to the drill string (drill collar), and the initial positions of the main body 1, the anvil 2, the impact hammer 3, the conversion member 4, the mandrel 5, etc. in the present disclosure are as illustrated in FIG. 2; when drilling fluid enters the main body 1 and passes through the throttle nozzle 6, the arrangement of the lower conical annular platform 24 reduces the flow section area of the throttle nozzle 6, so that the drilling fluid produces a pressure difference under the action of the throttle nozzle 6 and forms high-pressure fluid; next, the high-pressure fluid enters the annular liquid flow cavity 10 through the first radial liquid flow via-hole 11, and then the fourth radial liquid flow via-hole 20 through the second radial liquid flow via-hole 16 to form a high-pressure cavity in the fourth radial liquid flow via-hole 20; the high-pressure fluid in the fourth radial liquid flow via-hole 20 applies a force on a side of the third slider 19 adjoining the fourth radial liquid flow via-hole 20, thus under the force the third slider 19 is rotated anticlockwise from a rear side of the third groove 18 to a front side of the third slider 19, and the position of the third slider 19 after the anticlockwise rotation is as illustrated in FIG. 3; since the circumferential bump 41 close to the first groove 12 and the side of the second groove 13 abut against each other, the anticlockwise rotation of the impact hammer 3 causes the conversion member 4 to be rotated, and at the same time, the high-pressure fluid continuously enters the annular liquid flow cavity 10; in FIG. 3, since the second radial liquid flow via-hole 16 and the fourth radial liquid flow via-hole 20 are communicated with the rear side of the third groove 18, the high-pressure fluid forms high-pressure cavities in the second radial liquid flow via-hole 16, the fourth radial liquid flow via-hole 20 and the rear side of the third groove 18; the high-pressure fluid in the second radial liquid flow via-hole 16 applies a rotational force on the conversion member 4, so that the first slider 14 and the second slider 15 are simultaneously rotated anticlockwise; the second slider 15 is rotated from a rear side of the second groove 13 to a front side of the second groove 13, so that the circumferential bump 41 goes away from the rear side of the second groove 13, and the positions of the first slider 14 and the second slider 15 after the anticlockwise rotation are as illustrated in FIG. 4; in FIG. 4, since the third radial liquid flow via-hole 17 and the fifth radial liquid flow via-hole 21 are communicated with the annular liquid flow cavity 10, the high-pressure fluid enters the third radial liquid flow via-hole 17 and the fifth radial liquid flow via-hole 21 to form high-pressure cavities in the third radial liquid flow via-hole 17 and the fifth radial liquid flow via-hole 21; the high-pressure fluid in the fifth radial liquid flow via-hole 21 applies a force on the third slider 19, so that the third slider 19 is rotated clockwise from a front side of the third groove 18 to a rear side of the third groove 18, and the position of the third slider 19 after the clockwise rotation is as illustrated in FIG. 5; in FIG. 5, since the front side of the third groove 18, the third radial liquid flow via-hole 17 and the fifth radial liquid flow via-hole 21 are communicated with the annular liquid flow cavity 10, the high-pressure fluid enters the third radial liquid flow via-hole 17, the fifth radial liquid flow via-hole 21 and the front side of the third groove 18 to form high-pressure cavities in the front side of the third groove 18, the third radial liquid flow via-hole 17 and the fifth radial liquid flow via-hole 21; the high-pressure fluid in the third radial liquid flow via-hole 17 applies a rotational force on the conversion member 4, so that the first slider 14 and the second slider 15 are simultaneously rotated clockwise, the second slider 15 is rotated clockwise from a front side of the second groove 13 to a rear side of the second groove 13, and the positions of the first slider 14 and the second slider 15 after the clockwise rotation are as illustrated in FIG. 2. As can be seen from the above descriptions, the present disclosure completes an impact cycle. During the cyclical movement of the present disclosure, the reciprocating impact on the anvil 2 by the impact hammer 3 enables the impact hammer 3 to apply an impact force on the anvil 2, and the impact force is transferred to the PDC drill bit through the anvil 2, thereby providing an additional shearing impact force on the PDC drill bit.

The invention claimed is:

1. A torsion impact speed acceleration device, comprising a main body, an anvil, an impact hammer, a conversion member, a mandrel and a throttle nozzle; an inner limiting boss is provided at an upper inner side of the main body, a drainage member is mounted between the inner limiting boss and the anvil, a lower conical annular platform which is a frustum having a wide upper portion and a narrow lower portion is provided at an upper inner side of the throttle nozzle, a lower portion of the anvil is fixed with a lower portion of the main body through locating devices, an upper outer side of the mandrel is fixed with a lower inner side of the drainage member, a lower outer side of the mandrel is fixed with a lower inner side of the anvil, an outer side of the throttle nozzle is fixed with a lower inner side of the mandrel, the conversion member and the impact hammer are sheathed sequentially between an outer side of the mandrel and an inner side of the anvil, an annular liquid flow cavity is provided between a middle outer side of the mandrel and an upper inner side of the conversion member, at least one first radial liquid flow via-hole in communication with the annular liquid flow cavity is distributed circumferentially on the mandrel above the throttle nozzle, an inner side of the impact hammer is provided with a first groove and a second groove, an outer side of the conversion member is provided with a first slider rotatable circumferentially in the first groove and a second slider rotatable circumferentially in the second groove, a second radial liquid flow via-hole and a third radial liquid flow via-hole both in communication with the annular liquid flow cavity are distributed circumferentially on the second slider, the second radial liquid flow via-hole is located on the second slider between the first slider and the third radial liquid flow via-hole, the inner side of the anvil is provided with a third groove, an outer side of the impact hammer corresponding to and outward of the second groove is provided with a third slider rotatable circumferentially in the third groove, a fourth radial liquid flow via-hole capable of being in communication with the second radial liquid flow via-hole and a fifth radial liquid flow via-hole capable of being in communication with the third radial liquid flow via-hole are distributed circumferentially on the impact hammer and adjoin two sides of the third slider, respectively, an annular liquid cavity is provided between the outer side of the mandrel and the inner side of the anvil below the conversion member and the impact hammer, and an inclined flow channel in communication with the annular liquid cavity is provided on the mandrel below the throttle nozzle.

2. The torsion impact speed acceleration device according to claim 1, wherein an upper conical annular platform which is a frustum having a wide upper portion and a narrow lower portion is provided at an upper inner side of the drainage member, a buffering groove is provided at a middle outer side of the drainage member, a drainage hole in communication with the buffering groove is provided on the drainage member, a left drainage elongated slot and a right drainage elongated slot both in communication with the buffering groove are provided at a lower outer side of the drainage member, and a left-semicircle opened elongated slot and a right-semicircle opened elongated slot are distributed at an outer side of the anvil, wherein the left drainage elongated slot and the left-semicircle opened elongated slot are up-down corresponding to and communicated with each other, and the right drainage elongated slot and the right-semicircle opened elongated slot are up-down corresponding to and communicated with each other.

3. The torsion impact speed acceleration device according to claim 2, wherein a sixth radial liquid flow via-hole in communication with the first groove is provided on a portion of the impact hammer corresponding to and outward of the first groove, a seventh radial liquid flow via-hole in communication with the second groove is provided on a portion of the impact hammer corresponding to and outward of the second groove, and an eighth radial liquid flow via-hole capable of being in communication with the sixth radial liquid flow via-hole and a ninth radial liquid flow via-hole capable of being in communication with the seventh radial liquid flow via-hole are distributed circumferentially on the anvil, wherein the ninth radial liquid flow via-hole is in communication with the left-semicircle opened elongated slot, and the eighth radial liquid flow via-hole is in communication with the right-semicircle opened elongated slot.

4. The torsion impact speed acceleration device according to claim 3, wherein the locating device comprises a detent ball, a detent board, a compression spring and a pressing cap, wherein at least two locating blind holes are distributed circumferentially at an interval at an outer side of the anvil, locating threaded holes corresponding to the locating blind holes are distributed on the main body, the pressing cap is fixedly mounted in the locating threaded hole, and the compression spring, the detent board and the detent ball are compressively mounted in this order in the locating blind hole and the locating threaded hole.

5. The torsion impact speed acceleration device according to claim 4, wherein a first limiting annular boss is provided at the outer side of the mandrel above the inclined flow channel, the conversion member is seated on the first limiting annular boss, a second limiting annular boss is provided at the inner side of the anvil above the annular liquid cavity, the impact hammer is seated on the second limiting annular boss, a limiting bump is provided at a lower outer side of the conversion member, a limiting open groove corresponding to the limiting bump is provided at the inner side of the impact hammer, and the limiting bump abuts against an inner side of the limiting open groove.

6. The torsion impact speed acceleration device according to claim 5, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

7. The torsion impact speed acceleration device according to claim 4, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

8. The torsion impact speed acceleration device according to claim 3, wherein a first limiting annular boss is provided at the outer side of the mandrel above the inclined flow channel, the conversion member is seated on the first limiting annular boss, a second limiting annular boss is provided at the inner side of the anvil above the annular liquid cavity, the impact hammer is seated on the second limiting annular boss, a limiting bump is provided at a lower outer side of the conversion member, a limiting open groove corresponding to the limiting bump is provided at the inner side of the impact hammer, and the limiting bump abuts against an inner side of the limiting open groove.

9. The torsion impact speed acceleration device according to claim 8, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

10. The torsion impact speed acceleration device according to claim 3, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

11. The torsion impact speed acceleration device according to claim 2, wherein the locating device comprises a detent ball, a detent board, a compression spring and a pressing cap, wherein at least two locating blind holes are distributed circumferentially at an interval at an outer side of the anvil, locating threaded holes corresponding to the locating blind holes are distributed on the main body, the pressing cap is fixedly mounted in the locating threaded hole, and the compression spring, the detent board and the detent ball are compressively mounted in this order in the locating blind hole and the locating threaded hole.

12. The torsion impact speed acceleration device according to claim 11, wherein a first limiting annular boss is provided at the outer side of the mandrel above the inclined flow channel, the conversion member is seated on the first limiting annular boss, a second limiting annular boss is provided at the inner side of the anvil above the annular liquid cavity, the impact hammer is seated on the second limiting annular boss, a limiting bump is provided at a lower outer side of the conversion member, a limiting open groove corresponding to the limiting bump is provided at the inner side of the impact hammer, and the limiting bump abuts against an inner side of the limiting open groove.

13. The torsion impact speed acceleration device according to claim 12, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

14. The torsion impact speed acceleration device according to claim 11, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

15. The torsion impact speed acceleration device according to claim 2, wherein a first limiting annular boss is provided at the outer side of the mandrel above the inclined flow channel, the conversion member is seated on the first limiting annular boss, a second limiting annular boss is provided at the inner side of the anvil above the annular liquid cavity, the impact hammer is seated on the second limiting annular boss, a limiting bump is provided at a lower outer side of the conversion member, a limiting open groove corresponding to the limiting bump is provided at the inner side of the impact hammer, and the limiting bump abuts against an inner side of the limiting open groove.

16. The torsion impact speed acceleration device according to claim 15, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

17. The torsion impact speed acceleration device according to claim 2, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

18. The torsion impact speed acceleration device according to claim 1, wherein the locating device comprises a detent ball, a detent board, a compression spring and a pressing cap, wherein at least two locating blind holes are distributed circumferentially at an interval at an outer side of the anvil, locating threaded holes corresponding to the locating blind holes are distributed on the main body, the pressing cap is fixedly mounted in the locating threaded hole, and the compression spring, the detent board and the detent ball are compressively mounted in this order in the locating blind hole and the locating threaded hole.

19. The torsion impact speed acceleration device according to claim 18, wherein a first limiting annular boss is provided at the outer side of the mandrel above the inclined flow channel, the conversion member is seated on the first limiting annular boss, a second limiting annular boss is provided at the inner side of the anvil above the annular liquid cavity, the impact hammer is seated on the second limiting annular boss, a limiting bump is provided at a lower outer side of the conversion member, a limiting open groove corresponding to the limiting bump is provided at the inner side of the impact hammer, and the limiting bump abuts against an inner side of the limiting open groove.

20. The torsion impact speed acceleration device according to claim 19, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

21. The torsion impact speed acceleration device according to claim 18, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

22. The torsion impact speed acceleration device according to claim 1, wherein a first limiting annular boss is provided at the outer side of the mandrel above the inclined flow channel, the conversion member is seated on the first limiting annular boss, a second limiting annular boss is provided at the inner side of the anvil above the annular liquid cavity, the impact hammer is seated on the second limiting annular boss, a limiting bump is provided at a lower outer side of the conversion member, a limiting open groove corresponding to the limiting bump is provided at the inner side of the impact hammer, and the limiting bump abuts against an inner side of the limiting open groove.

23. The torsion impact speed acceleration device according to claim 22, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

24. The torsion impact speed acceleration device according to claim 1, wherein an outer limiting boss is provided at a lower outer side of the anvil, the main body is seated on the outer limiting boss, an internal thread or an external thread is provided at an upper portion of the main body, an internal thread is provided at the lower portion of the anvil, the upper outer side of the mandrel and the lower inner side of the drainage member are mounted together by thread tightening, the lower outer side of the mandrel and the lower inner side of the anvil are mounted together by thread tightening, the outer side of the throttle nozzle and a lower inner side of the mandrel are mounted together by thread tightening, and/or a circumferential bump is provided at an outer side of the second slider at a rear side of the second radial liquid flow via-hole, and a liquid flow elongated slot is provided between the circumferential bump and the rear side of the second radial liquid flow via-hole.

* * * * *